United States Patent [19]

Willcox

[11] Patent Number: 4,963,045

[45] Date of Patent: Oct. 16, 1990

[54] DISPENSER-APPLICATOR FOR SPREADING SUBSTANCES

[75] Inventor: Nancy A. Willcox, Costa Mesa, Calif.

[73] Assignee: The Willcox Family Trust, Costa Mesa, Calif.

[21] Appl. No.: 413,236

[22] Filed: Sep. 27, 1989

Related U.S. Application Data

[63] Continuation of Ser. No. 50,910, May 15, 1987, abandoned.

[51] Int. Cl.[5] ..... B65D 85/74

[52] U.S. Cl. ..... 401/132; 401/184; 401/12; 222/107; 206/440

[58] Field of Search ..... 401/6, 12, 132, 176, 401/184, 185, 261, 265, 196, 263, 262; 15/209 R; 222/95, 107; 206/277, 440

[56] References Cited

U.S. PATENT DOCUMENTS

| | | | |
|---|---|---|---|
| 96,085 | 10/1869 | Cole | 401/47 |
| 602,897 | 4/1898 | Daboll | 15/209 R |
| 1,007,589 | 10/1911 | McKinnon | 401/196 |
| 1,217,054 | 2/1917 | Pearman | 15/209 R |
| 1,887,447 | 11/1932 | Balinger | 401/184 |
| 2,048,103 | 7/1936 | Cleaves | 15/209 R |
| 2,098,966 | 11/1937 | Kingman | 401/196 |
| 2,110,000 | 3/1938 | Kingman | 401/196 |
| 2,179,735 | 11/1939 | Beem | 401/196 |
| 2,300,684 | 11/1942 | Maxfield | 401/12 X |
| 2,750,767 | 6/1956 | Von Knauf et al. | 401/12 |
| 2,829,393 | 4/1958 | Turcotte | 15/131 |
| 2,878,967 | 3/1959 | Duke | 222/107 |
| 2,927,335 | 3/1960 | Hammond | 401/184 |
| 2,961,677 | 11/1960 | Zecchini | 15/131 |
| 3,014,579 | 12/1961 | Lathrop | 206/56 |
| 3,214,781 | 11/1965 | Johnson et al. | 15/514 |
| 3,289,826 | 12/1966 | Mosier et al. | 206/226 |
| 3,315,801 | 4/1967 | Lowry | 206/56 |
| 3,334,374 | 8/1967 | Watkins, Jr. | 15/539 |
| 3,369,709 | 2/1968 | Clauss | 222/107 |
| 3,386,793 | 6/1968 | Stanton | 401/132 |
| 3,395,822 | 8/1968 | Donleavy | 215/11 |
| 3,453,661 | 7/1969 | Repko | 401/132 |
| 3,768,916 | 10/1973 | Avery | 401/132 |
| 3,818,911 | 6/1974 | Fournier | 128/269 |
| 3,826,259 | 7/1974 | Bailey | 128/269 |
| 3,860,348 | 1/1975 | Doyle | 401/6 |
| 3,896,808 | 7/1975 | Szpur | 128/269 |
| 4,127,339 | 11/1978 | Malacheski et al. | 401/132 |
| 4,148,318 | 4/1979 | Meyer | 128/269 |
| 4,173,978 | 11/1979 | Brown | 128/269 |
| 4,183,684 | 1/1980 | Avery, Jr. | 401/133 |
| 4,240,760 | 12/1980 | Levine | 401/201 |
| 4,291,697 | 9/1981 | Georgevich | 128/269 |
| 4,308,633 | 1/1982 | Van Huffel et al. | 15/104.93 |
| 4,360,020 | 11/1982 | Hitchcock | 604/289 |
| 4,427,111 | 1/1984 | Laipply | 401/132 X |
| 4,430,013 | 2/1984 | Kaufman | 401/132 |
| 4,493,574 | 1/1985 | Redmond | 401/132 |
| 4,515,703 | 5/1985 | Haq | 252/92 |
| 4,519,795 | 5/1985 | Hitchcock | 401/132 |
| 4,596,481 | 6/1986 | Tanaka | 401/132 |
| 4,643,725 | 2/1987 | Schlesser et al. | 604/306 |
| 4,648,506 | 3/1987 | Campbell | 401/132 X |
| 4,701,168 | 10/1987 | Gammons | 604/310 |
| 4,786,534 | 11/1988 | Aiken | 428/34.2 |

FOREIGN PATENT DOCUMENTS

| | | | |
|---|---|---|---|
| 945918 | 4/1974 | Canada | 190/148 |
| 0078596 | 11/1983 | European Pat. Off. . | |
| 1628564 | 2/1971 | Fed. Rep. of Germany . | |

*Primary Examiner*—Richard J. Johnson

*Attorney, Agent, or Firm*—Burns, Doane, Swecker & Mathis

[57] ABSTRACT

An applicator adapted for storing and spreading premeasured portions of liquid, gel, creamy, low-melting semi-solid or solid substances on surfaces is disclosed. The applicator has a rigid base and a thin flexible cover attached to one side of the base to form, together with the base, a collapsible pocket for storing the substance. A handle is attached to the other side of the base. The thin, flexible cover includes one or more apertures wherethrough the substance contained in the pocket may flow out of the pocket. A protective sealing member, such as a thin film, is removably attached to the exterior of the flexible cover to seal or protect the apertures until the sealing member is removed from the cover. The flexible cover collapses as the substance is squeezed out of the pocket while it is being applied to a desired surface. When the substance contained in the applicator is a low-melting solid or semi-solid, the substance melts or becomes flowable as it comes into contact with a warm surface on which the substance is to be spread.

25 Claims, 3 Drawing Sheets

FIG. 17
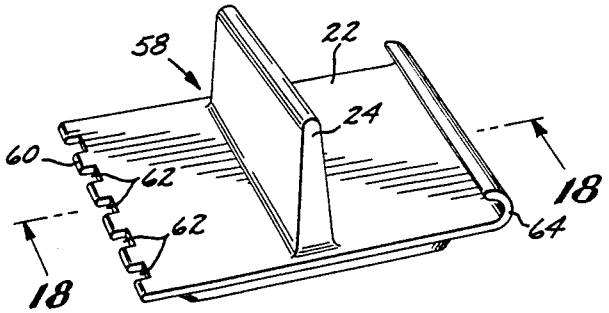
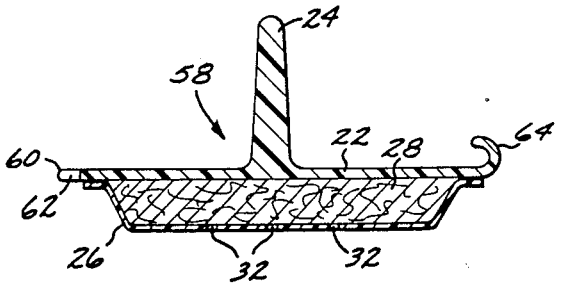
FIG. 18

DISPENSER-APPLICATOR FOR SPREADING SUBSTANCES

This application is a continuation, of application Ser. No. 07/050,910, filed May 15, 1987.

BACKGROUND OF THE INVENTION

1. Field of the Invention

The present invention is directed to a dispenser-applicator adapted for applying spreadable substances to solid surfaces. More particularly, the present invention is directed to a dispenser-applicator for applying pre-measured convenient amounts of spreadable substances, such as liquids, gels, lotions, and readily melting solids, to surfaces.

2. Brief Description of the Prior Art

Spreading various substances, such as lotions, ointments, gels, lubricants, skin medications, as well as liquidy or pasty foodstuffs, on solid surfaces, and frequently on irregular surfaces, is very old in the art. Spreading of lotions or semi-solid creamy or pasty external medications on various parts of the human body, and the application of butter to corn-on-the-cob may be mentioned in this connection as specific examples where a convenient, preferably pre-measured relatively small portion of a spreadable substance is to be applied preferably evenly to an irregular surface.

In view of the nature and ubiquitousness of the problem in human experience, it is perhaps not surprising that a very large number of dispenser devices adapted for various types of specific applications have been described in the prior art.

U.S. Pat. No. 3,334,374, for example, discloses an applicator pad having a liquid impermeable back wall, and a liquid permeable front wall with a pocket or storage space being formed between the two. The front wall may be a perforated sheet or an absorbent material. A liquid agent to be applied with the applicator pad is kept in rupturable capsules within the pocket When the applicator pad is pressed sufficiently firmly against a surface, the capsules are ruptured, and the liquid is applied to the surface through the front wall.

U.S. Pat. No. 2,961,677 discloses an applicator for a single dose of shoe polish or the like, having a porous pad. A pocket for liquid or liquidy paste is formed from a pierceable plastic material on one side of the porous pad in such a manner that during normal storage the liquid is isolated from the pad. A gripping member or handle is mounted to the plastic material leaving the front surface of the pad available for contact with a surface upon which the liquid is to be spread. When it is desired to use liquid or liquidy paste, the plastic wall separating the porous pad from the liquid is pierced with a needle and the liquid is slowly squeezed out to the surface through the pores of the pad.

U.S. Pat. No. 4,291,697 discloses a cleaning or applicator device which has a frangible capsule of liquid embedded in a relatively flat sponge member. The sponge embedding the capsule is mounted to an elongated handle. When it is desired to apply the liquid contents of the capsule with the sponge, pressure is exerted on the sponge to break the embedded capsule, and the liquid is allowed to soak into the sponge.

U.S. Pat. No. 4,430,013 describes an applicator for a liquid substance having a foam pad, and a liquid reservoir attached to one side of the pad. The liquid reservoir, although made of relatively rigid plastic, has a weakened portion, caused, for example, by a slit or scoring, so that pressure exerted in a given direction, or bending of the rigid plastic, breaks the weakened portion. When the weakened portion breaks, the liquid spills into the foam pad and is applied therefrom to a desired surface.

An applicator device somewhat similar in construction and operation to the just-described patented device is disclosed in U.S. Pat. No. 4,493,574. The "dispenser package" of the U.S. Pat. No. 4,493,574 has a flexible pouch adhered to a relatively stiff material. The package may be opened along a fault line or cut pattern in the stiff material by bending or flexing the stiff material in a V-shaped pattern. The dispenser package of this patent serves reasonably well for storing and dispensing single doses of liquid substances or liquidy pastes especially in situations where even spreading on a surface is not important. For example, the dispenser package of U.S. Pat. No. 4,493,574 serves reasonably well for dispensing certain liquidy or liquidy-pasty food condiments, such as mustard, ketchup, or honey.

U.S Pat. No. 4,493,574 also describes an embodiment of a dispenser package which contains a sponge to catch the liquidy substance when the overlying stiff material is broken along a fault line. This embodiment is said to be suitable for applying the liquidy substance to a surface in a "swab" type application. In reality, however, this device, due to its particular configuration and due to the presence of the relatively sharp edges of the broken stiff material, is not well suited for evenly spreading a liquid on any surface. This device is particularly ill suited for an application where the surface (such as a wounded skin) is sensitive to touch, pressure, or damage by the broken stiff material. The device of U.S. Pat. No. 4,493,574 is also not well suited for dispensing solid or semi-solid substances, and particularly not suited for relatively evenly dispensing and spreading solid or semi-solid substances on a solid surface, and even less so on an irregular surface.

Generally speaking, those dispensers and applicators of the prior art which aim to dispense a convenient single portion or dose of a spreadable material (for example, the applicator packages of U.S. Pat. Nos. 4,430,013 and 4,493,574) tend either to be unable to dispense all of their contents, or to dispense the contents in a poorly controlled manner and therefore waste the spreadable material. This is clearly undesirable.

For more background and detailed information on the prior art to the present invention, further reference is made to the following U.S. Pat. Nos. 2,829,393; 3,014,579, 3,214,781; 3,768,916; 3,818,911; 3,826,259; 3,896,808; 4,148,318; 4,173,978; 4,183,684; 4,240,760; 4,515,703, and to Canadian Patent No. 945918.

In light of the foregoing, it is apparent that the relatively large number of patent disclosures and devices developed in the prior art for dispensing liquid and pasty materials as well as for applying them on various surfaces, have not solved all problems related to this art. There is still further serious need in the art for dispensers and applicators well adapted for dispensing and applying convenient amounts, preferably single doses, in a well-controlled manner, not of just liquids but also of gels, semi-solids, and certain solids (such as butter), on solid surfaces. The present invention provides such applicator and dispenser devices.

SUMMARY OF THE INVENTION

It is an object of the present invention to provide a dispenser-applicator adapted for dispensing a pre-measured dose or portion of a liquid substance, and for applying the same to smooth or rough, regular or irregular solid surfaces.

It is another object of the present invention to provide a dispenser-applicator adapted for dispensing a pre-measured dose or portion of a solid or semi-solid substance which flows out from the applicator to be applied to any solid smooth or rough, regular or irregular surface, when the surface contacts the applicator and is sufficiently warm to melt the substance inside, or lower its viscosity sufficiently to make the substance flow under application of pressure.

It is still another object of the invention to provide a dispenser-applicator for pre-measured or convenient doses of medicinal ointments, solutions, and the like, which is particularly non-traumatic when used on broken, sensitive or injured skin, superficial wounds, or the like.

Generally speaking, it is an object of the present invention to provide a dispenser-applicator for pre-measured portions (or less) of liquid, gel, creamy, semi-solid or solid substances which can be relatively slowly released in a controlled manner from the applicator onto a surface as a result of applying motion and pressure, or in the case of solids and semi-solids as a result of applying sufficient heat to the applicator to cause a phase transition or marked drop in the viscosity of the contents of the applicator.

The foregoing objects and advantages are attained by an applicator having a substantially rigid base, and a thin flexible cover formed so as to create a dimensional cavity, which is bonded to the base to create a sealed collapsible pocket together with the base. A handle is attached to, or forms an integral part of, the side of the base opposite to where the cover forms the pocket with the base. The thin flexible cover includes at least one aperture wherethrough the substance contained in the pocket may flow out of the pocket. A protective sealing member, such as a flexible film or thin rigid material, is removably attached to the exterior of the flexible cover to seal the apertures until the protective sealing member is removed from the cover. The substance contained in the pocket may be a liquid, gel, cream, semi-solid or solid. When the substance is a liquid, the pocket may also contain a foam or like absorbent material to contain the liquid in its pores and allow it to be dispensed in a more controlled manner than in the absence of such absorbent material When the substance is a gel, cream, semi-solid or solid, it is of such a nature that either application of pressure or heat, or both, causes the substance to melt or substantially decrease its viscosity, or otherwise flow whereby the substance may be dispensed to a surface through the apertures of the flexible cover.

The substance, liquid, gel, cream, lotion, semi-solid, or low melting solid of the above-described nature, is applied to a surface after the protective sealing member is removed from its position on the cover sealing the apertures. The flexible cover is then pressed against the surface while the user holds the applicator by the handle. The flexible cover substantially conforms to the surface. If the contents are a liquid, gel, cream, lotion, or other "thixotropic" substance, gentle pressure on the applicator is sufficient to cause the substance to flow out to the surface while the substance is spread on the surface by lateral motion of the applicator. When the contents are a low melting solid or semi-solid, then melting or softening of the solid or semi-solid on contact with a "warm" surface combined with gentle pressure and lateral motion by the user, applies the substance to the desired area of the surface. "Warm" surface in this respect means a surface which has a temperature near to, or preferably above, the melting or softening temperature of the solid or semi-solid contents of the applicator. For example, a pre-measured portion of solid butter can be readily and conveniently spread on a warm or hot corn-on-the-cob with the applicator of the present invention.

The features of the present invention can be best together with further objects and advantages, by reference to the following description, taken in connection with the accompanying drawings, wherein like numerals indicate like parts.

BRIEF DESCRIPTION OF THE DRAWINGS

FIG. 17 is a perspective view of a seventh preferred embodiment with a protective sealing member omitted from the view, and FIG. 18 is a cross-sectional view of the seventh preferred embodiment, the cross-section being taken on lines 18,18 of FIG. 17.

DESCRIPTION OF THE PREFERRED EMBODIMENTS

Figure 1:
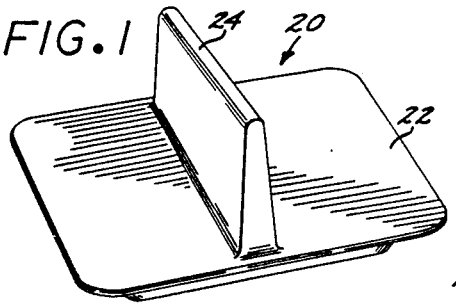
FIG. 1 is a perspective view of the first preferred embodiment of the applicator-dispenser device of the present invention with a protective sealing member omitted from the view.

The following specification, taken in conjunction with the drawings, sets forth the preferred embodiments of the present invention. The embodiments of the invention disclosed herein are the best modes contemplated by the inventors for carrying out their invention in a commercial environment, although it should be understood that several modifications can be accomplished within the parameters of the present invention.

Referring now to FIGS. 1–4 and 6–7 of the appended drawings, a first preferred embodiment 20 of the applicator-dispenser device of the present invention is disclosed. It should be noted at the outset that the applicator-dispenser device of the present invention is best adapted for storing and dispensing a relatively small amount of a substance which is thereafter desired to be spread, preferably relatively evenly, on a surface (not shown). Preferably, and in most applications of the invention, the dispenser-applicator holds a single convenient portion of the substance, although it should be understood that the user controls dispensing such that only the desired amount need be dispensed.

The substance itself can be a liquid, cream, gel, or semi-solid material, the physical properties of which are such that the material flows readily upon application of pressure. Liquid materials naturally flow readily even without pressure. Creams, gels, and like materials, generally speaking, flow readily only under pressure; sometimes such materials are "thixotropic" in the sense that their viscosity actually decreases once motion is attained under pressure.

Alternatively, and particularly when the substance is solid, it must be of such a nature that it melts readily or becomes capable of flowing under pressure when the dispenser-applicator comes into contact with the warm surface to which the substance is to be applied. Warm surface in this respect means a surface which is of sufficiently high temperature to cause melting, or the above-described viscosity change of the solid substance.

Generally speaking, the dispenser-applicator of the invention can be used for storing and dispensing liquid, creamy or cream-like, gelatinous, semi-solid or solid substances in a wide variety of fields of application. More specifically, the substance stored and dispensed by the dispenser-applicator of the invention may be a food item, such as butter, margarine, mustard, ketchup, honey, or liquidy or creamy condiment. The substance may be in the cosmetic or health-care field, for example, a shampoo, body-lotion, or medicinal lotion or ointment. Alternatively, the dispenser-applicator may contain a convenient amount for a one-time application of a household or industrial cleaning agent, or a material which has industrial or like application. For example, the substance may be a small portion (single portion) of adhesive or lubricating oil. It should be specifically understood in this regard that the present invention is not limited by the field of application of the substance which is dispensed from the novel dispenser-applicator.

Referring now again back to FIGS. 1–4 and 6–7, the first preferred embodiment 20 of the dispenser-applicator of the invention includes a substantially rigid base 22. The base 22, however, does not have to be absolutely rigid. If the dispenser-applicator is to be applied to a curved surface, the base 22 may be semi-rigid so as to allow the user to contour the base by applying finger pressure thus causing the dispenser-applicator to conform somewhat to the underlying curved surface. It should be understood that in this document, the term "substantially rigid" is meant to include semi-rigid and rigid. The base 22, as shown, is rectangular in the horizontal plane, although this shape is not critical and any other shape may be used. The base 22 is preferably made of plastic and can be made by such conventional technology as thermoforming or injection molding. However, metal, such as a thin aluminum stamping, may be suitable for some applications. In this regard it is noted that selection of material for the base 22 depends on the type of application, that is, the type of substance to be stored in the dispenser-applicator. For certain applications rigid polyvinyl chloride (pvc) may be suitable for the base 22; for certain medicinal and food distributing applications other plastics, such as a rigid polyester or high impact polystyrene, may be used.

What is important about the base, in light of the foregoing, is that the material and thickness be chosen to provide the desired rigidity or semi-rigidity, that the material may be compatible with the contents and provide adequate chemical and physical barrier properties, that the material be compatible with the cover material in terms of chemical stability, and that the cover and base be bondable to each other in surface-to-surface contact or by means of an intermediate material. What is also important about the base is, where it is desired to leave minimal residual contents in the dispenser-applicator, and where the surface of application is relatively flat along the area of contact between the dispenser-applicator and said surface, that the inner surface of the base should be substantially flat. If, however, a dispenser-applicator is to be made specifically for use on a particular convex curved surface, for example, a cylindrical surface such as a pipe, or a spherical surface such as a ball, then the base can be formed with an inherent curvature so as to substantially conform to the surface of application as the cover collapses. Inverse curvature of the base to fit concave surfaces is also possible.

In all applications, the surface of the base is generally continuous, to provide the desired chemical and physical barrier properties mentioned above, and generally smooth, to provide the desired dispensing and application action as discussed herein.

A handle 24 is affixed to one side of the relatively flat base 22. In the herein-described first preferred embodiment 20 the handle 24 is bar shaped, and is integrally constructed, for example, molded, with the base 22. The purpose of the handle 24 is to enable the user (not shown) to conveniently hold and gently press the dispenser-applicator 20 against a surface (not shown) to which the contents are to be applied. For automated applications, the handle 24 may be configured for optimum gripping by, or attachment to, a machine rather than by human hands.

In alternative embodiments the base may be bonded to the handle so as to make the base substantially rigid by virtue of being affixed to the handle, even though the material of the base may be flexible or resilient. For example the handle may be hollow and the base may be a member stretched between two opposite ends of the handle.

A flexible cover 26 is affixed to the base 22 on the side which is opposite to the location of the handle 24. The flexible cover 26 preferably comprises a relatively thin sheet of plastic material, for example, 2.00 mil thick film of polyester. The cover 26 may also be a multi-layered film rather than a single layer. For example, the cover 26 may be a metallized plastic film, or a laminate of foil and film, or a film possessing multiple layers of different types of plastic with or without metal.

Selection of material for the flexible cover 26 also depends on the particular field of application, or stated differently, on the type of substance dispensed by the applicator-dispenser device of the invention. For example, where it is required to have a cover 26 possessing relatively low water vapor transmission and low oxygen transmission, a dual-layer film such as polypropylene/polyvinylidene chloride is one choice, or another choice is metallized polyester. There are still additional choices with substantially equivalent properties. A certain degree of flexibility, sufficient to collapse under gentle pressure while the contents are dispensed, compatibility with the stored substance, and adequate tear strength and abrasion resistance for the intended application are important requirements for the flexible cover 26 The stored substance bears the reference numeral 28 on the drawing Figures.

Generally speaking, specific plastic or metallized plastic materials are chosen in accordance with the state of packaging arts, for the base 22 and cover 26, such that they possess the physical/chemical barrier properties required to store the specific desired contents, and such that they possess the respective mechanical requirements described above for rigidity or flexibility. The materials are also selected on the basis of characteristics required to accomplish the bond or seal between cover and base, and to tolerate any processing regimen required, such as heating or various methods of sterilization. Many choices of materials exist for each application of the dispenser-applicator. For one embodiment of the present invention which dispenses butter, the base 22 comprises 10 to 15 mil thick (near the periphery) semi-rigid polyester, and the cover 26 is a flexible 2 mil thick composite film of polyester/polyvinylidene chloride, the latter surface of which is coated with a heat sealant layer of low density polyethylene. The cover and base are affixed together by sealing the periphery with heat and pressure (heat-sealing).

For the purposes of this description, the term "heat sealing" includes all techniques where heat is directly applied or induced in opposed surfaces such that at least part of the underlying material is melted so as to bond the opposed surfaces together. Thus, heat sealing in the present description includes the techniques of ultrasonic welding, dielectric heating, and radio-frequency welding.

In the herein-described first preferred embodiment 20 the flexible cover 26 is bonded to the periphery of one side of the base 22 by a suitable adhesive. On FIG. 4, an adhesive 30 is shown between the cover and the base. However, this illustration is also meant to convey bonding in a broader sense, so that item 30 on the drawing may also represent a layer of heat-sealant material which has been melted and thereby bonded to the cover and the base; or alternately, the cover and the base materials have been fused together directly by heat and pressure and item 30 is indicative of the zone of fusion.

In alternative embodiments the flexible cover 26 may itself comprise a film including a heat sealable layer, and may be attached to the base 22 by heat sealing. In another alternative embodiment, the base rather than the cover may have an integral layer of material which provides the capability for heat-sealing. Also, another embodiment is where neither the cover nor base inherently possess a heat-sealant layer, but rather a thin film heat-sealant layer, capable of being sealed both to the cover and the base, is independently introduced between cover and base as part of the assembly process to manufacture the invention.

Generally speaking, state-of-the-art plastic article manufacturing and packaging techniques, machinery, and materials may be employed for manufacturing the dispenser-applicator devices of the present invention. Where it is desirable to have a metallic base, state-of-the-art metal-forming methods may be employed.

The flexible cover 26 forms, together with the base 22 a pocket or storage space wherein the substance 28 is contained. Referring now primarily to the bottom view of FIG. 2, a plurality of holes or apertures 32 are shown in the flexible cover 26 The purpose of the holes or apertures 32 is to permit the substance 28 to flow out of the applicator 20 when it is desired to spread the substance 28 on a receiving surface (not shown).

Figure 2:
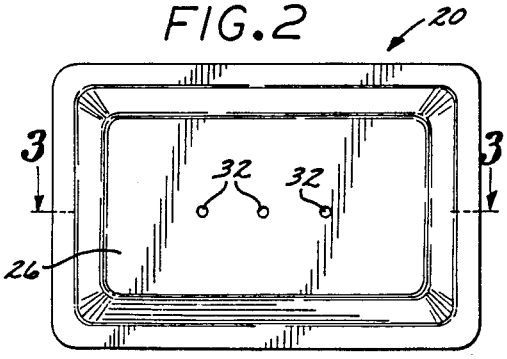
FIG. 2 is a bottom view of the first preferred with a protective sealing member being omitted from the view.
Figure 3:
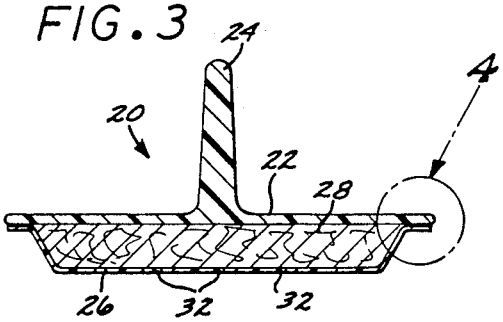
FIG. 3 is a cross-sectional view, the cross-section being taken on lines 3,3 of FIG. 2.
Figure 4:
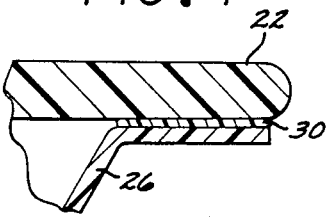
FIG. 4 is an enlarged view of the area indicated at 4 on FIG. 3.

As illustrated in FIG. 2 the first preferred embodiment 20 has only three holes 32. It should be expressly understood however in this connection that the number of holes or apertures 32 in the flexible cover 26, and their size and spacing depend on the nature of the substance 28, the characteristics of the surface to which the substance is to be applied, the typical pressure used during application and on the desired rate and pattern of flow of the substance 28 from the dispenser-applicator 20.

Figure 6:
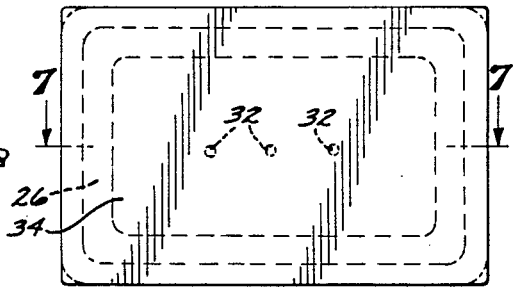
FIG. 6 is a bottom view of the first or second preferred embodiment, the view showing a first size of protective sealing member being lightly adhered or peelably sealed in place in the device.
Figure 7:
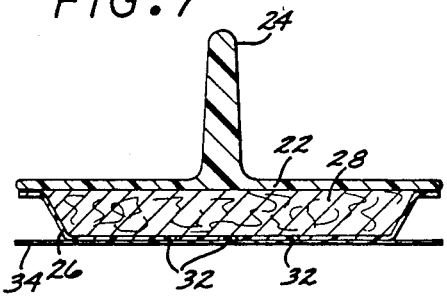
FIG. 7 is a cross-sectional view of the first preferred embodiment with the protective sealing member being in place in the device, the cross-section being taken on line 7,7 of FIG. 6.

Referring now further to FIGS. 6 and 7, a protective sealing member 34 is shown in contact with the bottom of the flexible cover 26 of the first preferred embodiment 20. The protective sealing member may be only lightly adhered or, alternately, bonded in place, to provide a leak-proof seal, as described in detail below. In some applications, for example when the substance 28 is a solid the sealing member 34 may be necessary only for sanitary reasons, that is, to the surface of the cover 26 clean. Further, where the substance is solid and where it is desired to keep the dispenser-applicator clean, the protective sealing member 34 may be omitted altogether provided the dispenser-applicator (singularly or multiply) is contained within a clean container such as a pouch or bag which itself protects against contamination.

For certain applications, in the first preferred embodiment the sealing member 34 is only lightly adhered to the cover 26 by weak interactive forces which occur between the respective materials of the sealing member 34 and the cover 26. These weak interactive forces, primarily electrostatic or hydrophobic in nature, are commonly termed "cling". The "cling" may also be caused (in full or in part) by the presence of a small amount of the contents between the cover 20 and the sealing member 34. In many applications, when the substance is a liquid or a low viscosity gel or the like, the protective sealing member 34 is needed not only to keep the cover 26 clean but also to seal the apertures 32 in a leak-proof manner and thereby to retain the substance 28 in the dispenser-applicator 20.

Depending on the nature of the application, the protective sealing member 34 may be made from several types of materials, but is generally a thin plastic film, for example, 0.6 mil thick polyvinylidene chloride. Because, generally speaking, the sealing member 34 must have the same chemical barrier properties as the cover 26, it is, generally speaking, selected from the same materials.

The protective sealing member 34 is, of course, removably, or peelably, attached to the flexible cover 26, so that it can be removed before the substance 28 is to be dispensed from the applicator 20 of the invention.

In addition to "cling", several methods known in the art, for example weak adhesive bonding or peelable heat-sealing in a frangible strip or the like, may be used for removably attaching the protective sealing member 34 to the cover 26. In certain embodiments the protective sealing member 34 is a plastic film coated either with a heat-sealant layer (such as polyethylene) or with a pressure sensitive adhesive.

When the protective sealing member 34 is bonded to the cover 26 in a leak-proof manner, the area, geometry, and exact location of the seal about the periphery of the perforations is variable. What is important is that the seal be sufficient to prevent the contents from escaping through the seal to the exterior. The thickness and type of film chosen for the protective sealing member 34 depends, in part, on the required barrier properties and method of bonding the protective member 34 to the cover 26. The material chosen must possess sufficient tensile strength such that it does not tear when being peeled away from the cover. The material must also possess sufficient cohesive strength that it does not suffer a cohesive failure and separate internally when peeled away from the cover. Such materials and characteristics are well known in the art of plastic film packaging, both for heat-sealed films and adhesively sealed films.

In one particularly important application of the present invention, the substance 28 is solid butter which flows out of the applicator 20 only when the applicator touches a surface (not shown) sufficiently hot to melt or soften the butter. In this application, one embodiment of the protective sealing member 34 is conveniently a piece of waxed paper which is "bonded" to the substantially flat bottom of the flexible cover by "cling" caused, at least in part, by the presence of a thin film of butter.

As a second example where butter is the contents, a cover 26 is comprised primarily (and on the external surface) of polyvinylidene chloride. Used in conjunction, a suitable protective member 34 is a piece of SARAN WRAP® (Dow Chemical), which is an approximately 0.6 mil thick film of polyvinylidene chloride. This material has the property of clinging to itself. Any residual butter on the surface of the cover does not interfere with the clinging together of this specified cover and this specified protective member.

As a third example where butter or ointment is the contents, the cover is made of a 2 mil thick dual-layer film of polyester and polyvinylidene chloride. The protective sealing member is of the same basic composition as the cover, but also possesses a thin layer of polyethylene, wherein the polyethylene surface provides the heat-sealant layer and allows the protective member to be heat-sealed to the cover in a peelable seal.

Thus, when it is desired to apply the substance 28 from the dispenser-applicator 20, a user (not shown) grips the handle 24 with thumb and forefinger, and with the other hand removes the protective sealing member 34 from the flexible cover 26, thereby exposing the holes or apertures 32. The contents of the dispenser-applicator 20 are then forced to slowly flow out to a desired surface (not shown) by gently pressing the flexible cover against the surface (not shown) and moving laterally about the desired surface so as to distribute the content over the desired area. More particularly, when the substance is a cream, gel, lotion, or the like, then the pressure exerted by the user (not shown) in conjunction with motion about the surface is sufficient to slowly and gradually squeeze the contents out of the applicator 20 and substantially control the distribution of the contents about the surface. When the substance 28 in the dispenser-applicator is a low melting solid, such as butter, then the solid (butter) first melts because of its contact with a warm or hot surface (not shown) and the resulting melted butter floWs out of the applicator through the holes 32. The flexible cover 26 gradually collapses as the substance is released from the dispenser-applicator, so that virtually all of the substance can be squeezed out of the applicator 20.

Generally speaking, gentle pressure and some lateral motion is required to dispense the contents of the applicator in a relatively even and controlled manner, although in some cases gentle pressure may be sufficient. The following explanation explains this issue in detail. If the perforations 32 of the cover 26 are located approximately centrally, then in the unusual situation when the dispenser-applicator is applied to a very smooth flat surface and pressed upon that surface, the contents 28 will not be dispensed because the surface in effect presses back against the cover sealing the periphery of each perforation. Then in order to dispense the contents, relative motion of the dispenser-applicator is used along the surface. Such motion combined with inherent surface friction creates shearing forces along the plane of the perforations, literally shearing the contents away and causing them to be deposited in a thin layer on the surface of application. Alternatively, using the same dispenser-applicator on a rough surface, that is, a surface where there are surface features such as crevices or bumps to which the area of the cover around the perforations cannot totally conform when the dispenser-applicator is pressed against said surface, then flow of contents can occur without lateral motion, tending to fill those non-conformal areas and possibly escaping out from under the dispenser-applicator away from the periphery, depending on the degree of surface roughness. In contrast, however, if the perforations of the cover are located at or near the extreme periphery of the cover rather than centrally, then when the full dispenser-applicator is applied to either a smooth surface or a rough surface, the perforations will be generally above the level of the surface. Then as pressure is applied, the contents will be squeezed out of the dispenser-applicator in directions away from its periphery at some elevation above the surface. In view of the preceding discussion it can be generalized that the dispenser-applicator can be configured so as to substantially dispense its contents without lateral motion. However, subsequent lateral motion would be required if it is desired to redistribute the contents about the surface. Therefore, the preferred way to use the dispenser-applicator to accomplish relatively uniform surface distribution of contents is typically to apply pressure and lateral motion simultaneously.

As the contents of the device are expressed from it, the cover 26 collapses and moves toward the inner surface of the base 22, so as to approximate this surface; thus, in the preferred embodiments, this inner surface of the base 22 is flat, or nearly flat, such that as the cover 26 approximates this surface, there is little or no "dead volume" in which the contained substance might be trapped and therefore inaccessible. This characteristic of minimal dead volume gains in importance as the contents gain in cost In the illustrated preferred embodiment of FIG. 1, the cover is shown as a formed film, and is produced by conventional means such as thermoforming. For most applications of the invention, the film comprising the cover can be formed into its final shape prior to insertion of the contents, for example, by thermoforming. However, in alternative embodiments the cover is initially a stretchable flat film, and concomitant with the filling operation becomes stretched into its final configuration. Alternatively, the cover can be an initially shrinkable film larger than needed in final form, is partially or completely bonded to the periphery of the base, and at some step subsequent or concomitant to the filling operation, is shrunk into its final smaller configuration.

Figure 5:
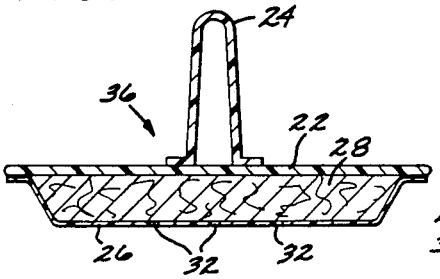
FIG. 5 is a cross-sectional view of the second embodiment of the applicator-dispenser device of the present invention, with a protective sealing member being omitted from the view.

FIG. 5 shows a second preferred embodiment 36 of the dispenser-applicator of the present invention. The second preferred embodiment 36 differs from the first preferred embodiment 20 only in the construction of the handle 24. In the second preferred embodiment 36, the handle 24 is a separate piece of substantially rigid plastic and is not integrally constructed with the base 22. Rather, it is attached to the base 22, for example, by use of a suitable adhesive (not shown).

The handle may be configured in a variety of shapes and attached or bonded to the base in a variety of ways known to those skilled in the art of plastic article manufacturing. What is important about the handle is that it be configured and sized adequately for gripping with fingers (or for attachment to a machine) and that it be rigid enough to allow the user to control the motion of the dispenser-applicator.

Figure 8:
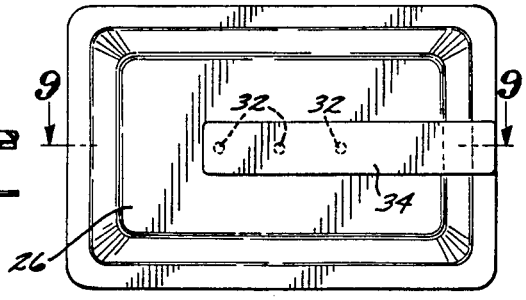
FIG. 8 is a bottom view of a third preferred embodiment of the applicator-dispenser device of the present invention, the view showing a second size of protective sealing member peelably sealed in place on the device.
Figure 9:
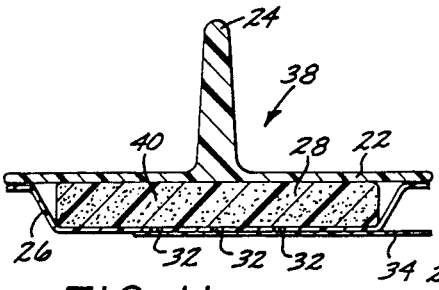
FIG. 9 is a cross-sectional view, the cross-section being taken on lines 9,9 of FIG. 8.

FIGS. 8 and 9 show a third preferred embodiment 38 of the dispenser-applicator of the present invention for use with liquid contents. In this embodiment 38, the protective sealing member 34 is an elongated strip of material which covers and peelably seals the apertures 32 in a leak-proof seal. The size of the sealing member 34 shown here is much smaller than that of the first preferred embodiment 20 shown on FIGS. 6 and 7, which is a relatively large rectangular piece of material. The protective sealing member 34 can be of various size in relation to the size of the cover 26. In FIG. 6, it is shown of sufficient size to substantially cover the cover 26. In FIG. 8, it is shown as an approximately rectangular narrow strip, sealing the holes in the cover 26, but covering only a small proportion of the cover 26. The latter was done for clarity in illustrating that the protective sealing member is not necessarily large. In fact, the protective member can be so small as to just cover or seal the holes 32 with a small surplus to allow a finger grip for peeling, or large enough to totally overlap all portions of the cover 26. The choice of size and shape depends on the degree of sanitary precautions necessary and manufacturing considerations.

Another special feature of the third preferred embodiment 38 is that, enclosed within the rigid base 22 and the flexible cover 26, it contains an absorbent foam 40, sponge, or like material. Consequently the third preferred embodiment 38 is eminently suitable for storing and dispensing low viscosity liquid materials. Such liquids are squeezed out of the absorbent foam 40 through the apertures 32 as the user (not shown) presses the applicator against the surface (not shown) to which the liquid substance 28 is to be applied.

Figure 10:
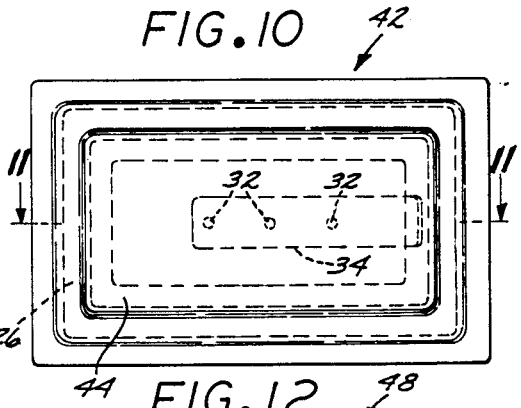
FIG. 10 is a bottom view of a fourth preferred embodiment.
Figure 11:
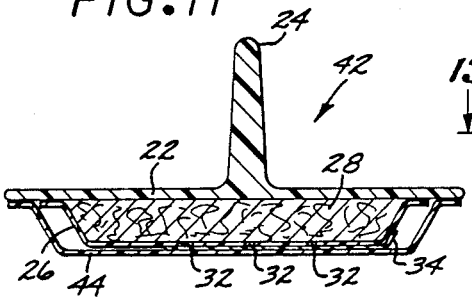
FIG. 11 is a cross-sectional view of the fourth preferred embodiment the cross-section being taken on lines 11,11 of FIG. 10.

FIGS. 10 and 11 illustrate a fourth preferred embodiment 42 of the invention. This embodiment 42 is highly suitable for storing and dispensing certain medicinal lotions or other materials in situations where the surface of the flexible cover 26 must be kept relatively clean. To insure cleanliness, a protective cover 44 (possessing no apertures) is removably attached by heat sealing, adhesive, or by some other suitable means known in the art, to the periphery of the base 22. Thus, the protective cover 44 encloses the flexible cover 26 and the protective sealing member 34. Referring still primarily to the concept of providing a protective cover 44 for the dispenser-applicator of the invention, when the contents 28 are a solid, the protective member 34 can be omitted. When it is desired to add physical protection, the cover 44 (similar to the one shown on FIG. 11) may be rigid, and may be snap-fitted to the base. Such a rigid cover is not intended to be leak-proof.

Referring still to medical uses and others requiring cleanliness, it is recognized that in the fourth embodiment 42, in FIG. 11, the handle 24 and base 22 of the dispenser-applicator are not protected from contamination. It is intended that the fourth embodiment 42 would most likely be used in a situation where quantity of clean individual dispenser-applicators are contained as a group within another clean container such as a protective pouch or box. The protective cover 44 is typically a tough flexible plastic film, such as 4 mil thick polyester, or a rigid plastic film, such as 18 mil thick Kodar® PETG copolyester (Eastman Chemical). The configuration of the seal between the protective cover 44 and base 22, as shown in FIG. 11, is only one possible variation, and the concept of using a protective cover 44, as shown, should be understood not to be limited by the specific embodiment 42. The geometry of the protective cover 44 and the filled dispenser-applicator is such that when the protective cover 44 is a thin tough film, it is suitable for peelable removal by peeling back from one end of the base 22, such that the film 44 collapses and and everts as it is pulled back so as to pass over the cover 26. When the protective cover 44 is a rigid film, it is removably attached to the base 22 in such a way that it can be pulled completely down and away in order to avoid interference and impingement on the cover 26.

Figure 12:
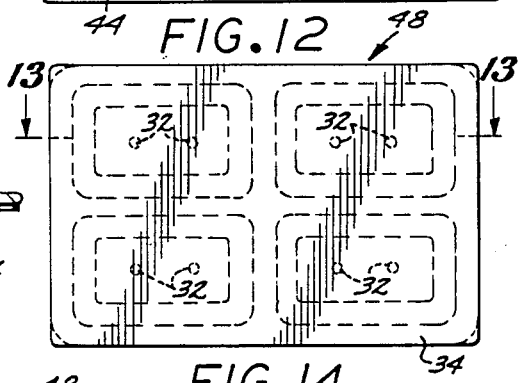
FIG. 12 is a bottom view of a fifth preferred embodiment.
Figure 13:
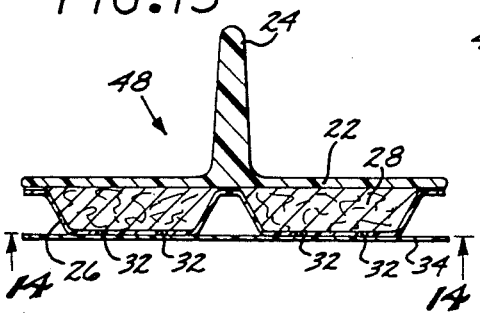
FIG. 13 is a cross-sectional view of the fifth preferred embodiment, the cross-section being taken on lines 3,13 of FIG. 12.
Figure 14:
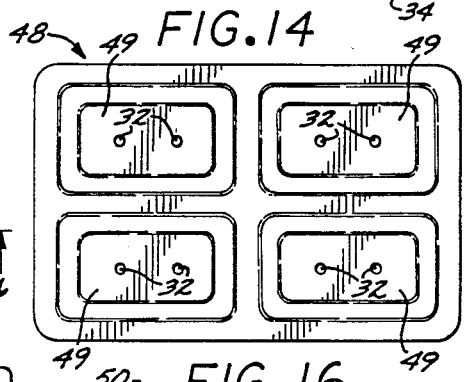
FIG. 14 is a bottom view of the fifth preferred embodiment with the protective sealing member removed.

FIGS. 12, 13, and 14 illustrate a fifth preferred embodiment 48 of the dispenser-applicator of the present invention. In the fifth preferred embodiment 48 several pockets are formed by attaching one or more flexible covers 26 to the base 22. Four pockets are illustrated here by way of example. Each pocket 49, of course, contains a substance 28 to be stored and dispensed with the applicator 48. The contents of the several pockets 49 may be identical with one another. Alternatively, and in certain preferred embodiments, the several pockets contain individual components of multi-component systems, for example, the separate components of a multi-component adhesive system.

Each flexible cover 26 has one or more apertures 32 on the bottom of each pocket 49, and the apertures or holes 32 for each pocket 49 are sealed preferably with a single protective sealing member 34, as is shown on FIG. 13 although each pocket could have its own individual protective sealing member. Use of the fifth preferred embodiment 48 for dispensing and applying one or more substances 28 from all pockets 49 at the same time is self-explanatory in light of the foregoing description and the drawing Figures. The fifth preferred embodiment with identical contents in each pocket is particularly useful for distributing the contents onto an extremely rough or irregular surface.

Figure 15:
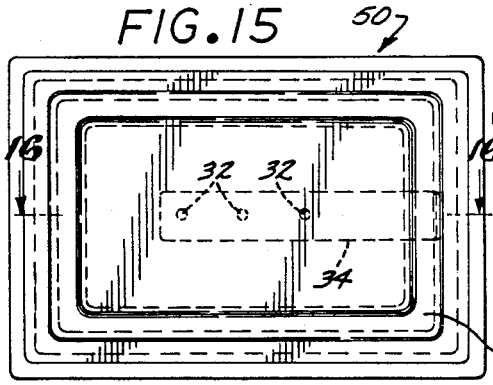
FIG. 15 is a bottom view of a sixth preferred embodiment.
Figure 16:
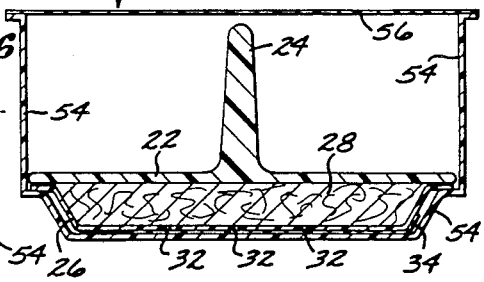
FIG. 16 is a cross-sectional view of the sixth preferred embodiment, the cross-section being taken on lines 16,16 of FIG. 15.

FIGS. 15 and 16 illustrate a sixth preferred embodiment 50 of the dispenser-applicator of the invention. For reasons of keeping the substance 28 contained in the sixth embodiment sterile, or tamper evident, or for some other health, safety, or related reason, the sixth embodiment 50 has an outer enclosure 52 which provides a microbial barrier and is capable of maintaining sterility of the handle 24, the base 22, and the flexible cover 26, and also of the contents 28 and of the protective sealing member 34. The enclosure 52 is made, for example, from two pieces of plastic, bonded (for example, glued or heat sealed) to one another, as is shown on the cross-sectional view of FIG. 16.

In light of the foregoing it should be understood that the enclosure 52 is intended to provide a microbial barrier to maintain sterility while simultaneously providing some physical protection to the dispenser-applicator. As one example, the enclosure 52 is comprised of two components: a rigid container 54 substantially deep such that the entire dispenser-applicator is contained within its volume, and a tough lidstock 56 which is peelably sealed to the container 54. The container 54 can be made, for example, of thermoformed 18 mil thick Kodar ® PETG copolyester (Eastman Chemical), with a lidstock 56 of "Kenpeel 124" (Kenpack Converters), a heat-sealable 4 mil thick co-extruded film of high density polyethylene and ethylene-vinyl acetate copolymer. Such an enclosure can be heat-sealed and is suitable for radiation sterilization. This enclosure is appropriate under circumstances where it is desired to utilize gamma radiation to sterilize the dispenser-applicator.

Referring now to FIGS. 17 and 18, a seventh preferred embodiment 58 of the dispenser-applicator of the present invention is disclosed. The seventh preferred embodiment 58 is similar in many respects to the first preferred embodiment, with the following noteworthy differences. One edge 60 of the base 22 contains a plurality of notches 62, whereas the other edge 64 has a curved-up lip shape. By holding the dispenser/applicator at an angle to the desired surface, and employing lateral motion, the notched edge 60 is utilized to "scrape" the surface upon which the contents have already been deposited, and thereby to form relatively evenly-spaced rows of the contents on the surface, and with relatively uniform thickness of each row. The curved-up lip 64 is used where it is desired to spread the substance further on the surface, particularly in an atraumatic manner. These are but two possibilities of a variety of edge configurations which can be utilized in order to further spread the contents in some desired way. These two configurations would not necessarily be used on the same dispenser/applicator and are shown in this fashion only for convenience of illustration.

Referring now to certain aspects of manufacturing the dispenser-applicators of the present invention, the following is noted. In the manufacturing process for the invention, whenever a leak-proof seal is required over the perforations of the cover 26, it is typical, although not mandatory, that the sealing member 34 is affixed to the cover 26 prior to the insertion of the contents into the cover. Two principal methods for inserting the contents into the cover 26 are mentioned. In the first method, the contents are inserted into the unattached cover, and subsequently bonding of the cover to the base is accomplished. This method is particularly useful for but not limited to, solids or semi-solids, or very viscous materials In the second method, the cover is partially bonded to the base 22 and the contents are injected (for example, through a hollow tube) through the remaining non-bonded periphery between the cover and base. Peripheral bonding is then completed. This method is particularly useful for liquids or low viscosity materials. Other filling methods are also possible For example, the rigid base could possess a small hole through which a smaller diameter tube is inserted to inject material into the cover, while air from the cover simultaneously vents out of the hole. The small hole can then be sealed with a drop of a suitable adhesive. In another possible method for filling with a solid or semi-solid material, the base 22 is held in an inverted position relative to FIG. 1, the desired material is loaded onto the inner surface of the base, and subsequently the cover is positioned from above, and is bonded to the base 22.

The invention is not limited to a particular size. Exemplary sizes for certain specific applicators and for preferred embodiments are given below. In those applications where a temperature differential between the dispenser-applicator and the surface is used to melt or lower the viscosity of the contents of the dispenser-applicator, in order to create more rapid heat transfer the numerical ratio of the average width of the cover to the depth of the cover would be large, for example, on the order of 5 or 10 to 1. A relatively small version of the dispenser-applicator can be used for buttering a cob of corn. For example, one set of representative dimensions for a "butterer" intended to butter one cob of corn are:

handle height, 10–15 mm
base, 30–40 mm square
depth of cover, 5–7 mm
width of perimeter seal, 4–6 mm.

The cover possesses, for example, three holes, each approximately 0.7 mm in diameter, located more or less centrally and approximately 5 mm from each other.

On the other hand, a larger version of the dispenser-applicator can be used to apply a medicinal ointment to the back of a burn victim, for example:

handle height, 30–40 mm
base, 80–100 mm square
depth of cover, 15–20 mm
width of perimeter seal, 5–10 mm.

Hole size, quantity, and spacing, in this embodiment, depends on factors as discussed elsewhere in this application.

Even larger versions are possible, for example, to apply printing ink to a large plate or roller, to apply lubricant to a giant bearing, or to apply adhesive to a large surface (for example, several square feet). Limitations in size are based primarily on strengths of bonds in the assembled dispenser-applicator, strengths of the materials used for cover and base, and convenience of use.

Several modifications in the construction and use of the above-described dispenser-applicator device may become readily apparent to those skilled in the art in light of the foregoing disclosure. Therefore, the scope of the present invention should be interpreted solely from the following claims.

What is claimed is:

1. A dispenser-applicator for dispensing a substance contained therein to a receiving surface and for spreading the substance on the receiving surface, the dispenser-applicator comprising:

a substantially rigid base having a generally continuous smooth surface grippable handle means; and a thin flexible substantially impervious plastic film sealed to the base so as to form a sealed collapsible pocket between the film and the surface of the base for containing the substance;

wherein the thin flexible plastic film is adapted to contact the receiving surface and has at least one aperture for dispensing the substance therethrough and onto the receiving surface by application of pressure on the base to collapse the pocket between the surface of the base and the receiving surface; wherein the film is positioned on the base such that as the pocket collapses the film moves toward the surface of the base and wherein the film is sufficiently thin and flexible such that (a) the film itself provides no significant resistance to the pressure applied to the base and essentially all pressure applied to the base transfers to the substance in the pocket, (b) the film conforms to the shape of the substance in the pocket when pressure is applied and remains in the shape of the substance in the pocket when the pressure is released and (c) the film distributes the applied pressure over the receiving surface and spreads the substances on the receiving surface of the dispenser-applicator is moved across the receiving surface.

2. A dispenser-applicator according to claim 1 comprising a sealing member removably attached to the exterior of the thin flexible film to seal at least one aperture.

3. A dispenser-applicator according to claim 1 comprising a protective cover removably attached to the exterior of the dispenser-applicator to protect the thin flexible film.

4. A dispenser-applicator according to claim 2 comprising a protective cover removably attached to the exterior of the dispenser-applicator to protect the thin flexible film and sealing member.

5. A dispenser-applicator according to claim 3 wherein the protective cover comprises an enclosure means for containing the dispenser-applicator.

6. A dispenser-applicator according to claim 2 wherein the sealing member is adhered to the thin flexible film by inherent chemical or physical attractive forces between the sealing member and the thin flexible film.

7. A dispenser-applicator according to claim 3 wherein the protective cover is removably sealed to the dispenser-applicator in a substantially leak-proof manner.

8. A dispenser-applicator according to claim 1 wherein the side of the base facing the pocket is substantially flat.

9. A dispenser-applicator according to claim 1 wherein the thin flexible film is sealed to the base so as to form a plurality of pockets, wherein there is at least one aperture in each portion of the film forming each pocket.

10. A dispenser-applicator according to claim 1 wherein a portion of one edge of the base contains notches.

11. A dispenser-applicator according to claim 1 wherein a portion of one edge of the base is a curved surface.

12. A dispenser-applicator according to claim 1 wherein a substance is present in the pocket.

13. A dispenser-applicator according to claim 12 wherein the substance comprises a liquid or a viscous liquid.

14. A dispenser-applicator according to claim 12 wherein the substance comprises a gel, a cream or a thixotropic material.

15. A dispenser-applicator according to claim 12 wherein the substance comprises a medical ointment.

16. A dispenser-applicator according to claim 13 wherein the substance comprises a medicinal ointment.

17. A dispenser-applicator according to claim 14 wherein the substance comprises a medicinal ointment.

18. A dispenser-applicator according to claim 12 wherein the substance comprises a food, an adhesive, a lubricant or a cleaning agent.

19. A dispenser-applicator according to claim 13 wherein the substance comprises a food, an adhesive, a lubricant or a cleaning agent.

20. A dispenser-applicator according to claim 14 wherein the substance comprises a food, an adhesive, a lubricant or a cleaning agent.

21. A dispenser-applicator according to claim 12 wherein the substance comprises a solid which becomes capable of flowing under pressure upon contact of the thin flexible film with the receiving surface.

22. A dispenser-applicator according to claim 21 wherein the substance is a solid which melts when the flexible film contacts a receiving surface which is warmer than the substance.

23. A dispenser-applicator according to claim 22 wherein the substance comprises a medicinal ointment.

24. A dispenser-applicator according to claim 22 wherein the substance comprises a food, an adhesive, a lubricant or a cleaning agent.

25. A dispenser-applicator according to claim 24 wherein the food comprises butter or margarine.

* * * * *

UNITED STATES PATENT AND TRADEMARK OFFICE

CERTIFICATE OF CORRECTION

PATENT NO. : 4,963,045

DATED : October 16, 1990

INVENTOR(S) : Nancy A. Willcox

It is certified that error appears in the above-identified patent and that said Letters Patent is hereby corrected as shown below:

Column 1, line 40 after "pocket" insert --.--, line 53 after "to use" insert --the--;
Column 3, line 52 after "material" insert --.--;
Column 4, line 15 after "best" insert --understood,--, line 24 after "applicator-dispenser" delete the period, line 27, after "preferred" insert --embodiment--, line 33 after "second" insert --preferred--, line 54 after "embodiment" insert --,--, line 59 delete "lines 3,13" and insert in place thereof --lines 13,13--;
Column 6, line 28 delete "may";
Column 7, line 27 after "cover 26" insert --.--;
Column 8 line 19 after "base 22" insert --,--, line 23 after "cover 26" insert --.--, line 29 delete "understood however" and insert in place thereof --understood, however,--, line 45, after "solid" insert --,--, line 46 after "to" insert --keep--, line 51 after "container" insert --,--;
Column 10, line 19 delete "floWs" and insert in place thereof --flows--;
Column 12, line 47 delete "and" (second occurrence);
Column 13 line 2 after "FIG. 13" insert --,--;
Column 14, line 9 after "for" insert --,--, line 10 after "materials" insert --.--, line 16 after "possible" insert --.--;

UNITED STATES PATENT AND TRADEMARK OFFICE

CERTIFICATE OF CORRECTION

PATENT NO. : 4,963,045

DATED : October 16, 1990

INVENTOR(S) : Nancy A. Willcox

It is certified that error appears in the above-identified patent and that said Letters Patent is hereby corrected as shown below:

Column 15, line 10 after "smooth surface" insert --and having--, line 34 delete "substances" and insert in place thereof --substance--, line 35 delete "of" and insert in place thereof --as--; and
Column 16, line 28 delete "medical" and insert in place thereof --medicinal--.

Signed and Sealed this

Twenty-third Day of February, 1993

*Attest:*

STEPHEN G. KUNIN

*Attesting Officer*

*Acting Commissioner of Patents and Trademarks*